US007275815B2

(12) United States Patent
Bertelsen et al.

(10) Patent No.: US 7,275,815 B2
(45) Date of Patent: Oct. 2, 2007

(54) DIE ATTACH METHODS AND APPARATUS FOR MICRO-FLUID EJECTION DEVICE

(75) Inventors: Craig M. Bertelsen, Union, KY (US); Kin M. Kwan, Lexington, KY (US); Sean T. Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 316 days.

(21) Appl. No.: 11/000,763

(22) Filed: Dec. 1, 2004

(65) Prior Publication Data

US 2006/0114297 A1 Jun. 1, 2006

(51) Int. Cl.
*B41J 2/175* (2006.01)

(52) U.S. Cl. ..... 347/85

(58) Field of Classification Search ..... 347/85, 347/87

See application file for complete search history.

(56) References Cited

U.S. PATENT DOCUMENTS 4,464,220 A * 8/1984 Beer ..... 156/273.3
6,210,522 B1 * 4/2001 Singh et al. ..... 347/50
6,220,688 B1 4/2001 Ishimatsu et al.
6,229,114 B1 5/2001 Andrews et al.
6,255,137 B1 7/2001 Gorczyca et al.
6,341,842 B1 * 1/2002 Beach et al. ..... 347/45
6,686,425 B2 2/2004 Wigdorski et al.
6,692,113 B2 2/2004 Silverbrook et al.
2005/0280680 A1 * 12/2005 Hess et al. ..... 347/92
2006/0000090 A1 * 1/2006 Smoot et al. ..... 29/890.1

FOREIGN PATENT DOCUMENTS

JP 2000-246905 A2 9/2000

OTHER PUBLICATIONS

U.S. Appl. No. 10/881,961, Anderson et al.
U.S. Appl. No. 10/880,898, Bertelsen et al.
U.S. Appl. No. 10/880,899, Bertelsen et al.

* cited by examiner

*Primary Examiner*—An H. Do
*Assistant Examiner*—Sarah Al-Hashimi
(74) *Attorney, Agent, or Firm*—Luedeka, Neely & Graham, PC

(57) ABSTRACT

A micro-fluid ejection device structure, a multi-fluid cartridge containing the ejection device structure, and methods for making the ejection device structure and cartridge. The micro-fluid ejection device structure includes a fluid supply body containing at least three fluid supply slots therein. An ejection head substrate having fluid feed slots therein is attached to the fluid supply body. Each of the fluid supply slots in the body is in flow communication with at least one of the fluid feed slots in the substrate. A plurality of adhesive bond lines adhesively attach the ejection head substrate and the fluid supply body to one another. Each of the adhesive bond lines have a width of less than about 600 microns and are located between adjacent ones of the fluid supply slots in the body.

6 Claims, 9 Drawing Sheets

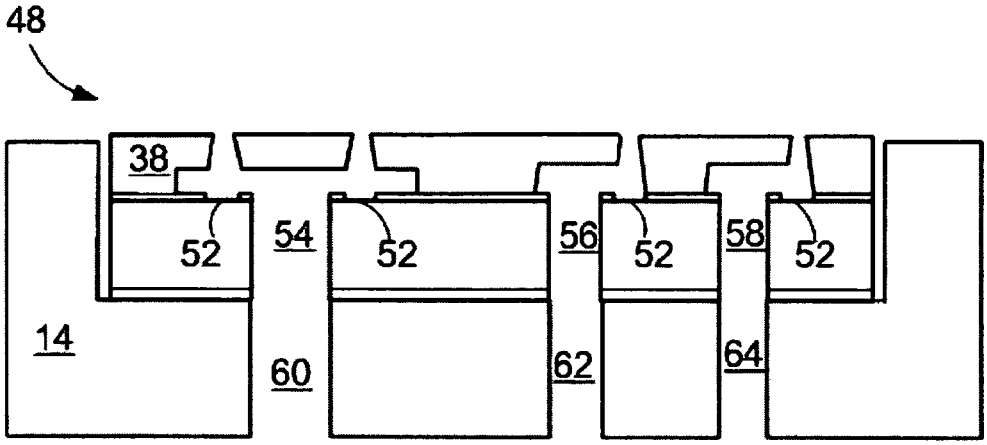
FIG. 7
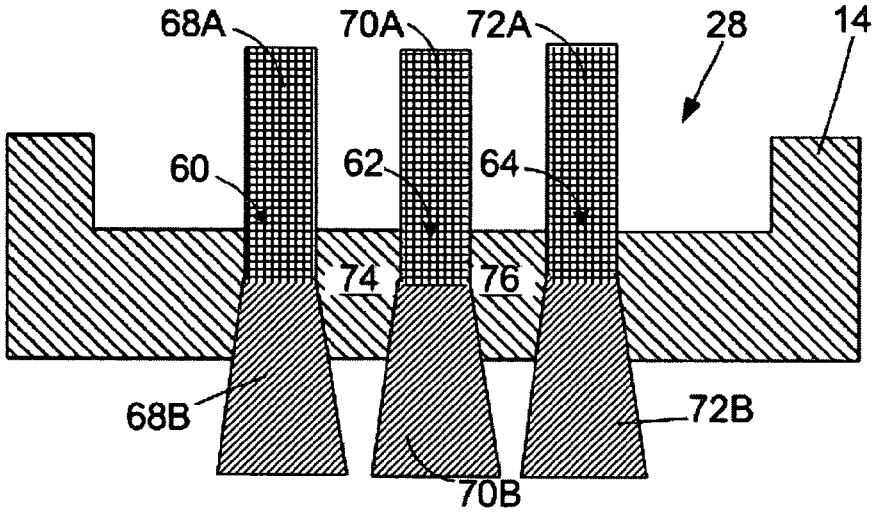
FIG. 8 - Prior Art
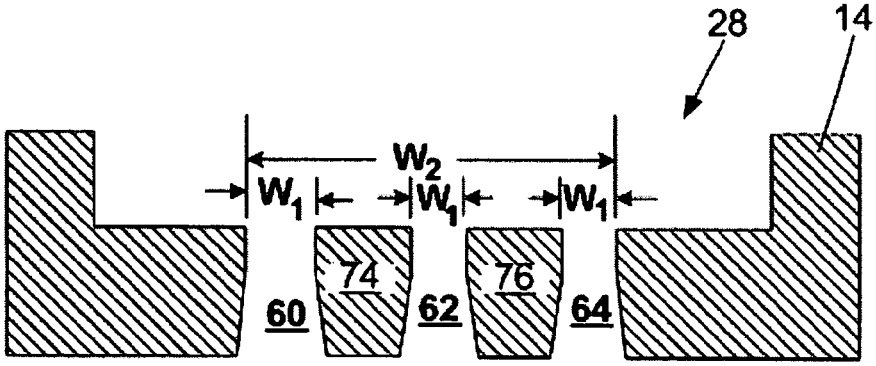
FIG. 9 - Prior Art

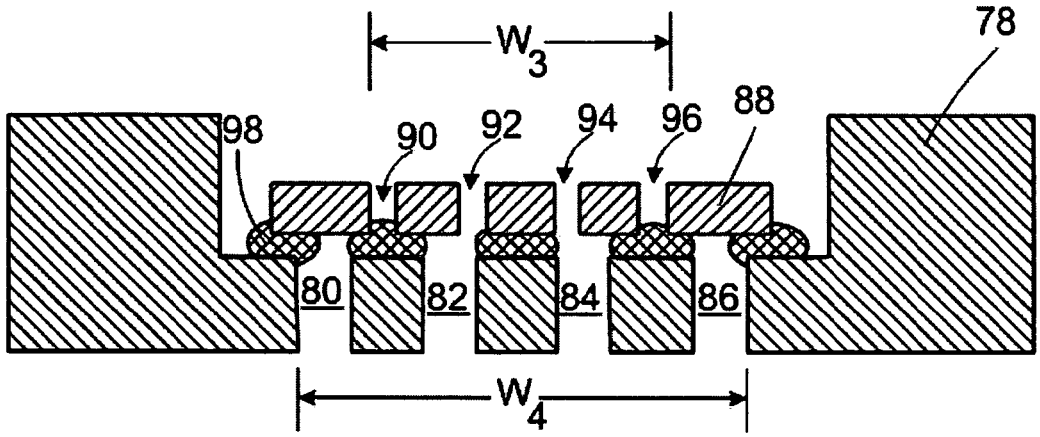
FIG. 10 - Prior Art
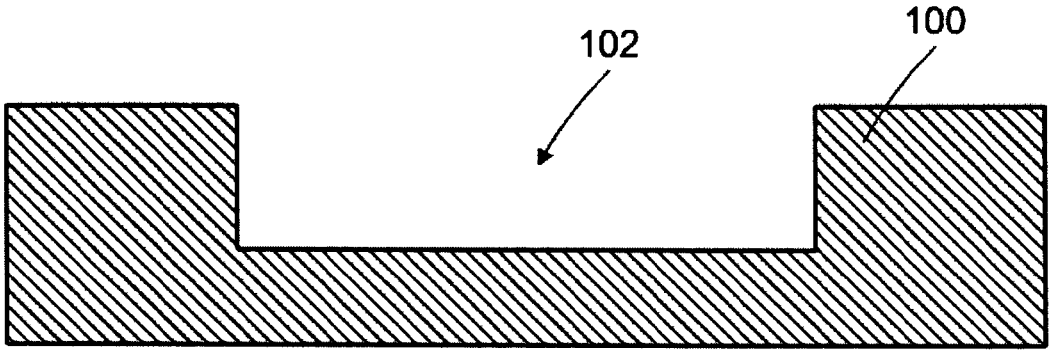
FIG. 11
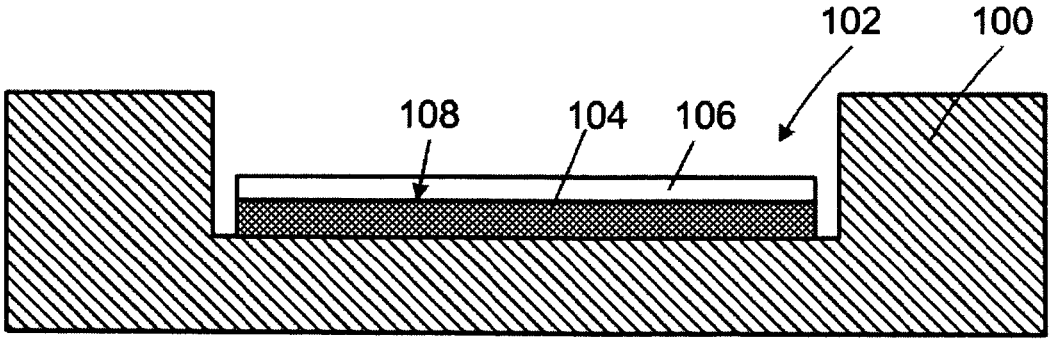
FIG. 12

DIE ATTACH METHODS AND APPARATUS FOR MICRO-FLUID EJECTION DEVICE

FIELD OF THE DISCLOSURE

The disclosure relates to micro-fluid ejection devices and in particular to structures and techniques for securing a semiconductor substrate to a multi-fluid reservoir.

BACKGROUND AND SUMMARY

In the field of micro-fluid ejection devices, ink jet printers are an exemplary application where miniaturization continues to be pursued. However, as micro-fluid ejection devices get smaller, there is an increasing need for unique designs and improved production techniques to achieve the miniaturization goals. For example, the increasing demand of putting more colors in a single inkjet cartridge requires the addition of fluid flow passageways from the cartridge body to the ejection head that, without radical changes in production techniques, will require larger ejection head substrates. However, the trend is to further miniaturize the ejection devices and thus provide even smaller ejection head substrates. An advantage of smaller ejection head substrates is a reduction in material cost for the ejection heads. However, this trend leads to challenges relating to the attachment of such substrates to a multi-fluid supply reservoir.

As the ejection heads are reduced in size, it becomes increasingly difficult to adequately segregate multiple fluids in the cartridges from one another yet provide the fluids to different areas of the ejection heads. One of the limits on spacing of fluid passageways in the ejection head substrate is an ability to provide correspondingly small, and closely-spaced passageways from the fluid reservoir to the ejection head substrate. Another limit on fluid passageway spacing is the ability to adequately align the passageways in the fluid reservoir with the passageways in the ejection head substrate so that the passageways are not partially or fully blocked by an adhesive used to attach to the ejection head to the reservoir.

Thus, there continues to be a need for improved structures and manufacturing techniques for micro-fluid ejection head components for ejecting multiple fluids onto a medium.

With regard to the foregoing, the disclosure provides a micro-fluid ejection device structure, a multi-fluid cartridge containing the ejection device structure, and methods for making the ejection device structure and cartridge. The micro-fluid ejection device structure includes a fluid supply body containing at least three fluid supply slots therein. An ejection head substrate having fluid feed slots therein is attached to the fluid supply body. Each of the fluid supply slots in the body is in flow communication with at least one of the fluid feed slots in the substrate. A plurality of adhesive bond lines adhesively attach the ejection head substrate and the fluid supply body to one another. Each of the adhesive bond lines have a width of less than about 600 microns and are located between adjacent ones of the fluid supply slots in the body.

In a second embodiment, the disclosure provides a method of making a micro-fluid ejection device structure for a multi-fluid cartridge. An adhesive is applied to a die bond surface of a fluid supply body. The adhesive and body are ablated to form a plurality of fluid flow slots through the adhesive and body and to provide adhesive bond lines having a width of less than about 600 microns. A semiconductor substrate containing a plurality of fluid ejection devices thereon is affixed to the adhesive.

In another embodiment, the disclosure provides a method of making a micro-fluid ejection device structure for a multi-fluid cartridge. The method includes applying a die bond adhesive layer to a multi-fluid cartridge body. A semiconductor substrate is affixed to the die bond adhesive. The semiconductor substrate contains a plurality of ejection actuators adjacent three or more fluid feed slots therein and a nozzle plate attached to the substrate. Fluid flow paths are laser formed in the adhesive and body corresponding to the fluid feed slots in the semiconductor substrate by passing a laser beam through the nozzle plate.

An advantage associated with at least some of the apparatus and methods disclosed herein is that multiple different fluids may be ejected from a micro-fluid ejection device that is less costly to manufacture and has dimensions that enable increased miniaturization of operative parts of the device. Continued miniaturization of the operative parts enables micro-fluid ejection devices to be used in a wider variety of applications. Such miniaturization also enables the production of ejection devices, such as a printer, having smaller footprints without sacrificing print quality or print speed. The exemplary apparatus and methods described herein can also reduce the size of a silicon substrate used in such micro-fluid ejection devices without sacrificing the ability to suitably eject multiple different fluids from the ejection devices.

BRIEF DESCRIPTION OF THE DRAWINGS

Further advantages of the embodiments described herein will become apparent by reference to the detailed description of exemplary embodiments when considered in conjunction with the drawings, wherein like reference characters designate like or similar elements throughout the several drawings as follows:

FIG. 7 is a cross-sectional view, not to scale, of a portion of a micro-fluid ejection head attached to a multi-fluid cartridge body according to the disclosure;

FIG. 8 is a cross-sectional view, not to scale, of a prior art method of molding fluid supply paths in a cartridge body structure;

FIG. 9 is a cross-sectional view, not to scale, of the prior art cartridge body structure molded according to FIG. 8;

FIG. 10 is a cross-sectional view, not to scale, of a cartridge body structure having a semiconductor substrate adhesively attached thereto according to a prior art process;

FIGS. 11-16 are cross-sectional views, not to scale, of a process for forming fluid paths in an adhesive layer and cartridge body structure according to one embodiment of the disclosure.

DETAILED DESCRIPTION OF THE EXEMPLARY EMBODIMENTS

Figure 1:
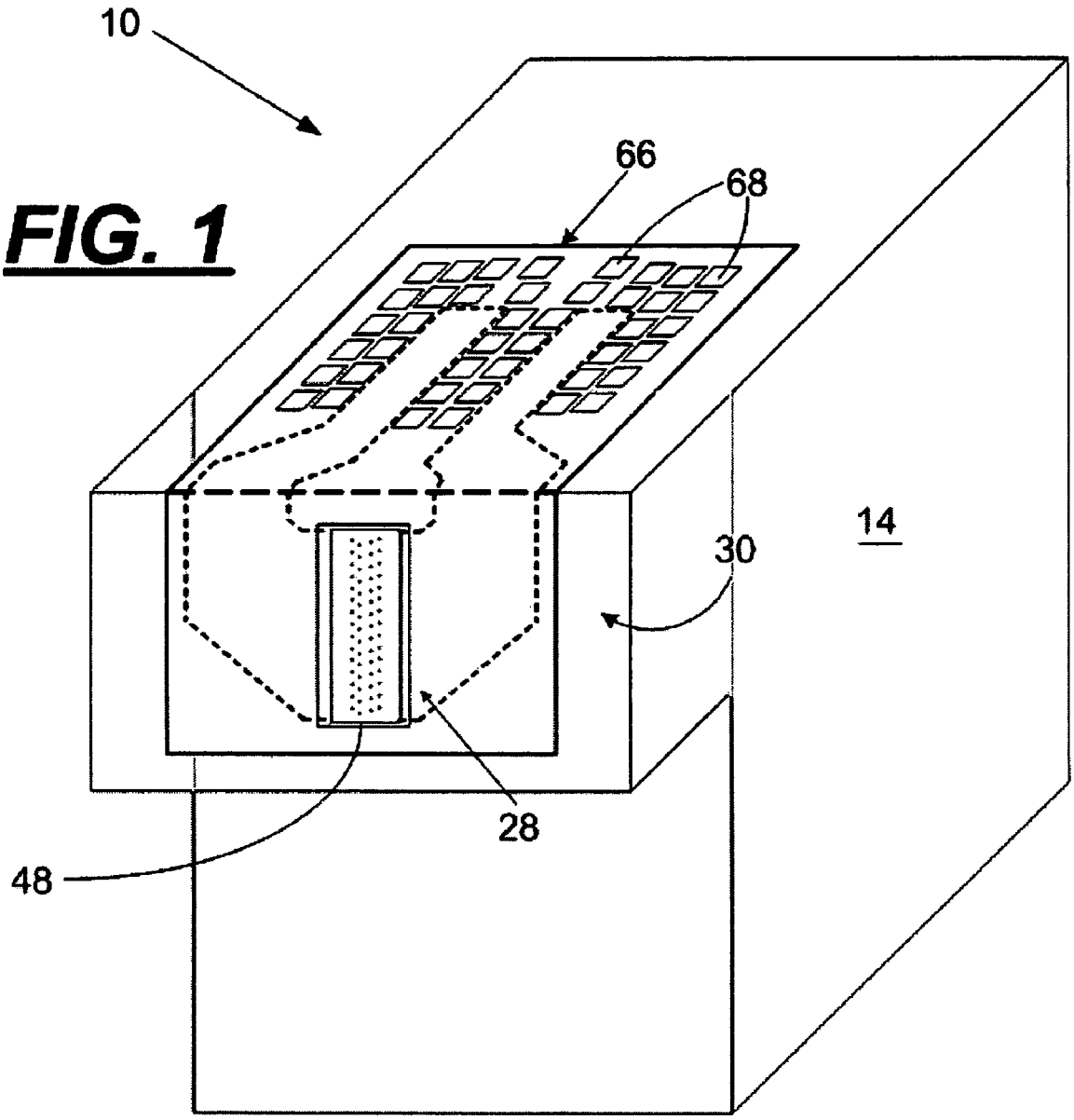
FIG. 1 is a perspective view, not to scale, of a fluid cartridge containing a micro-fluid ejection head according to the disclosure.
Figure 2:
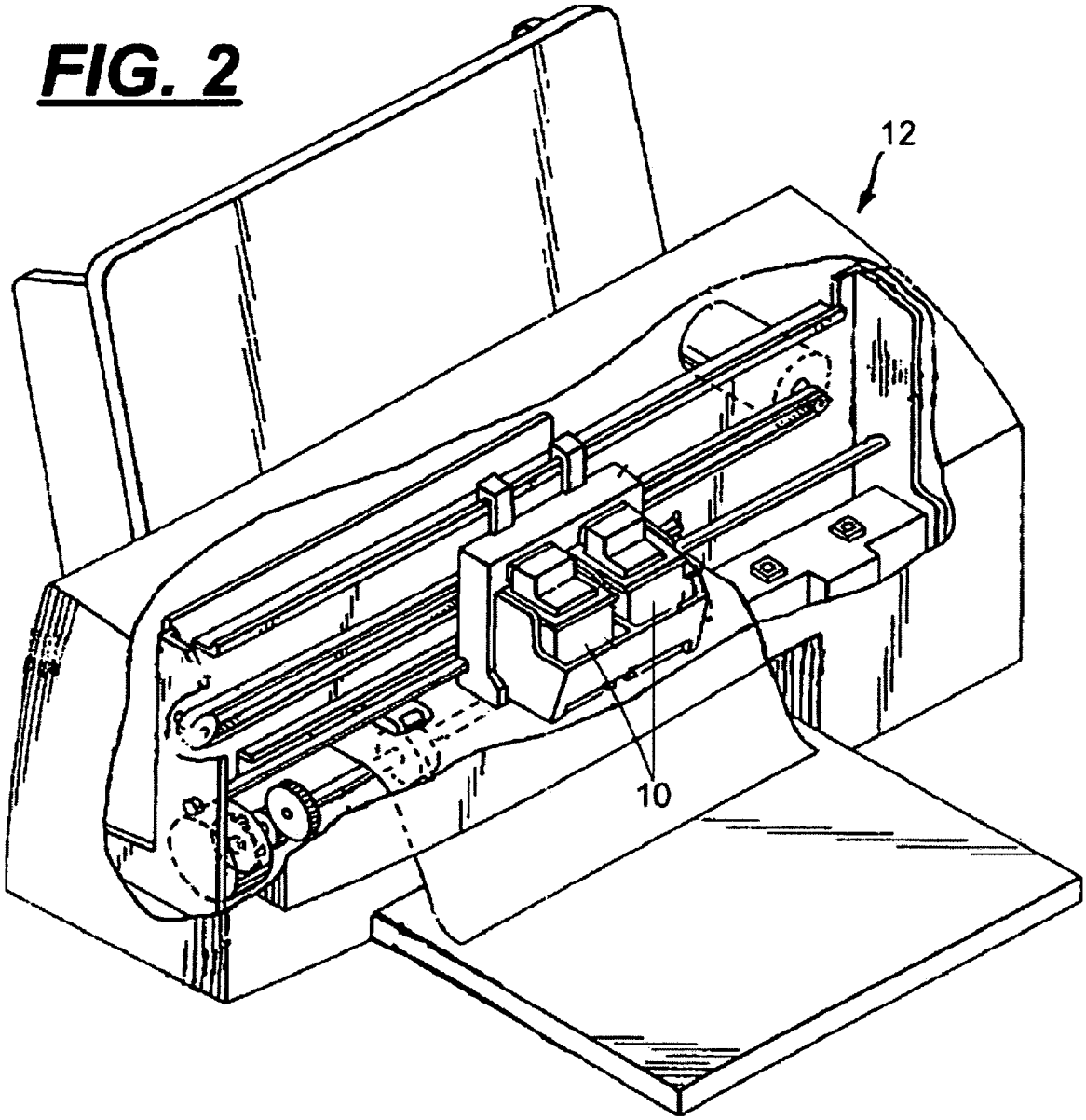
FIG. 2 is a perspective view, not to scale, of a micro-fluid ejection device containing fluid cartridges according to the disclosure.
Figure 3:
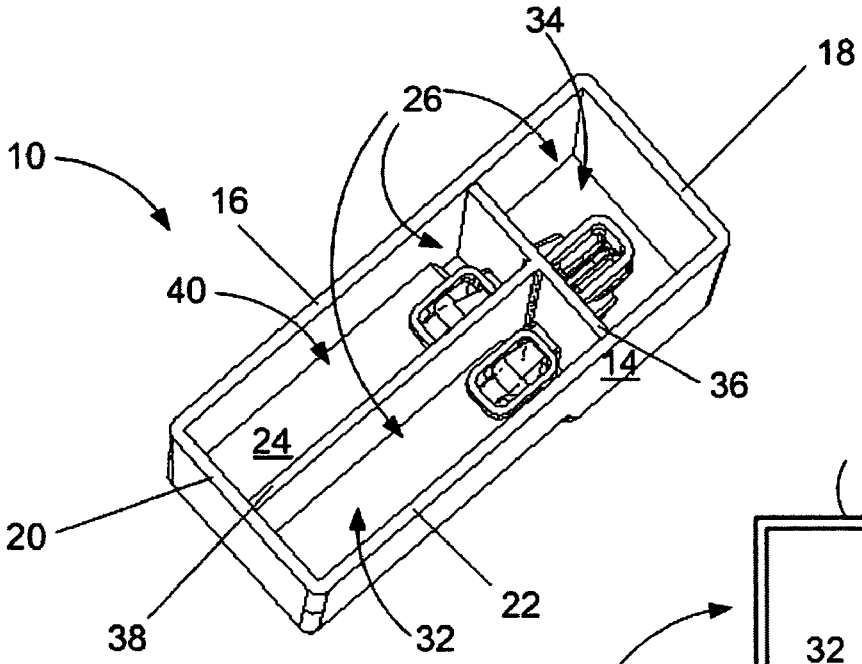
FIG. 3 is a perspective top view, not to scale, of a fluid cartridge body containing multiple fluid compartments according to the disclosure.
Figure 4:
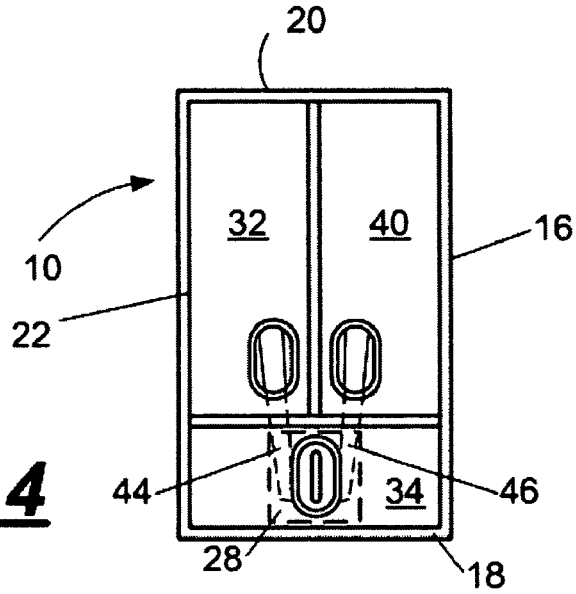
FIG. 4 is a top plan view, not to scale, of the fluid cartridge body of FIG. 3.
Figure 5:
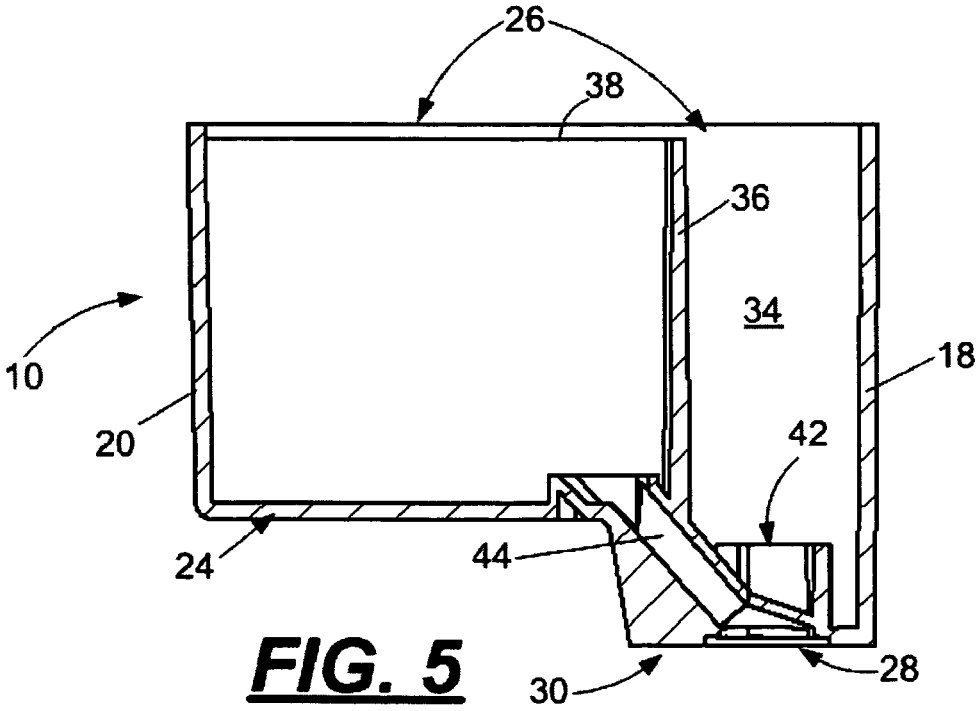
FIG. 5 is a side cross-sectional view, not to scale, of the fluid cartridge body of FIG. 3.

With reference to FIGS. 1-7, a multi-fluid cartridge body 10 (FIG. 1) for a micro-fluid ejection device, such as an ink jet printer 12 (FIG. 2) is illustrated. The multi-fluid body 10 includes a body structure 14 having exterior side walls 16, 18, 20, and 22 and a bottom wall 24 forming an open-topped, interior cavity 26 (FIGS. 3-6). An ejection head area 28 is disposed adjacent a portion 30 of the bottom wall 24 opposite the interior cavity 26. At least two segregated fluid chambers 32 and 34 are provided within the interior cavity 26 of the body structure 14. A dividing wall 36 separates chamber 32 from chamber 34. An additional dividing wall 38 may be provided to separate a third fluid chamber 40 from the chamber 32 for one of the cartridge bodies 10 containing three different fluids.

Figure 6:
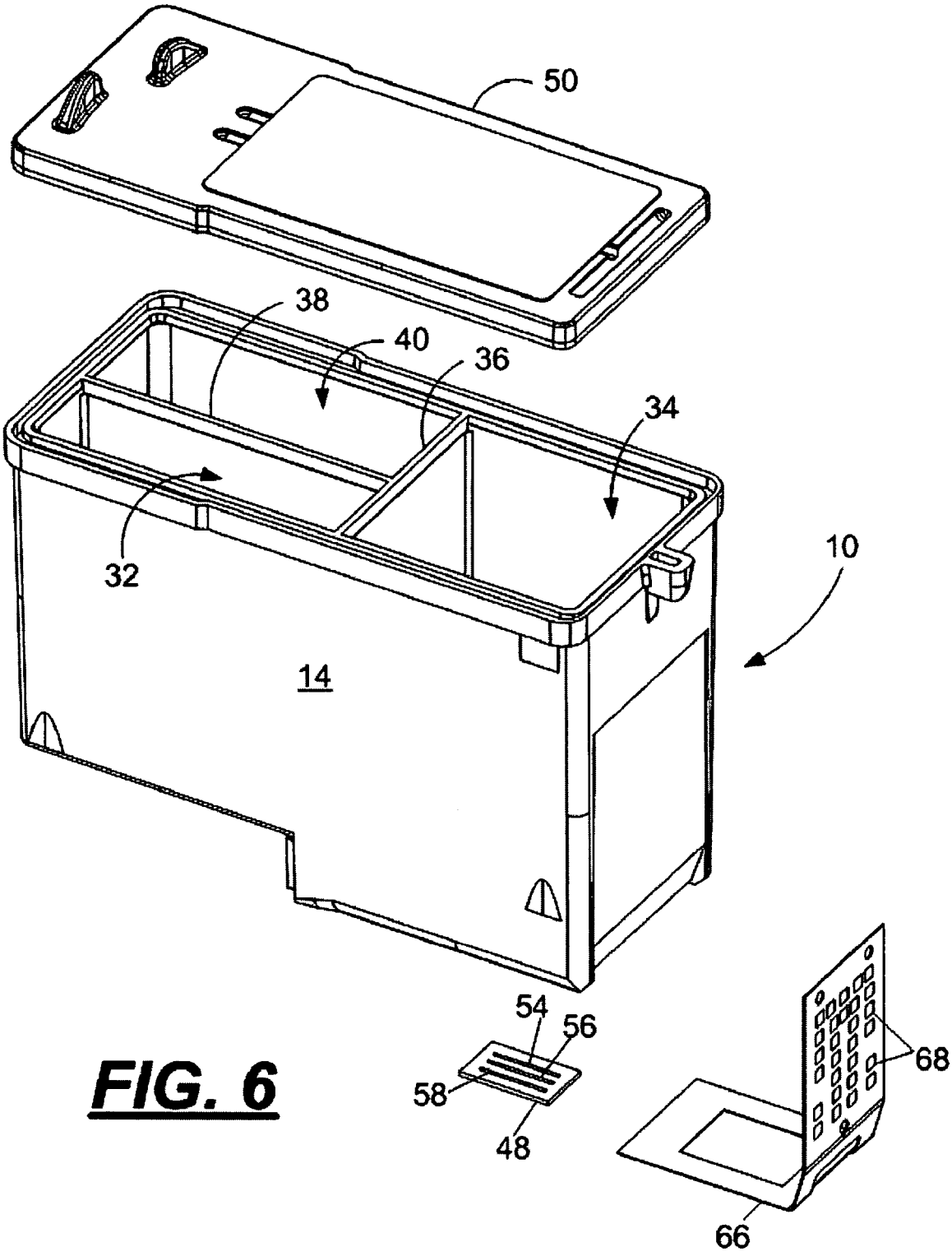
FIG. 6 is a perspective exploded view, not to scale, of a multi-fluid cartridge body according to the disclosure.
Figure 13:
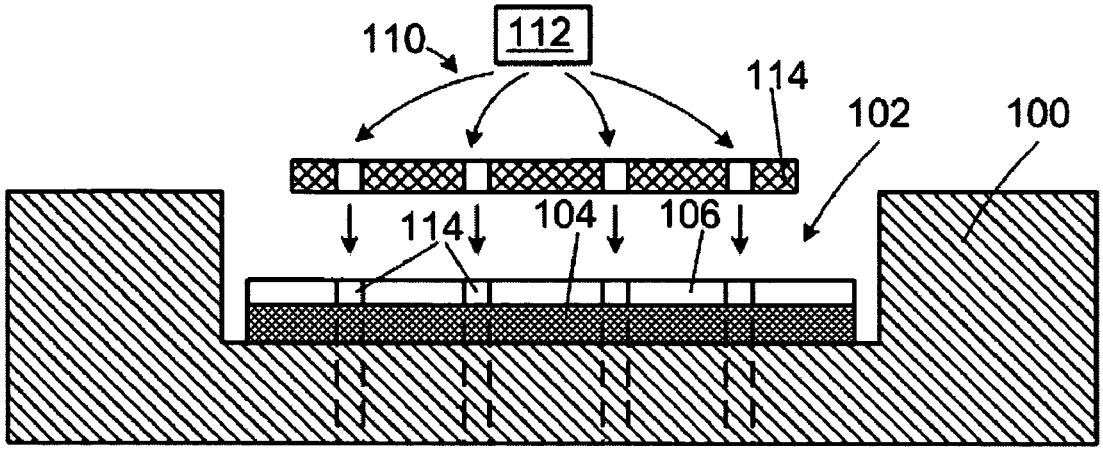
Figure 14:
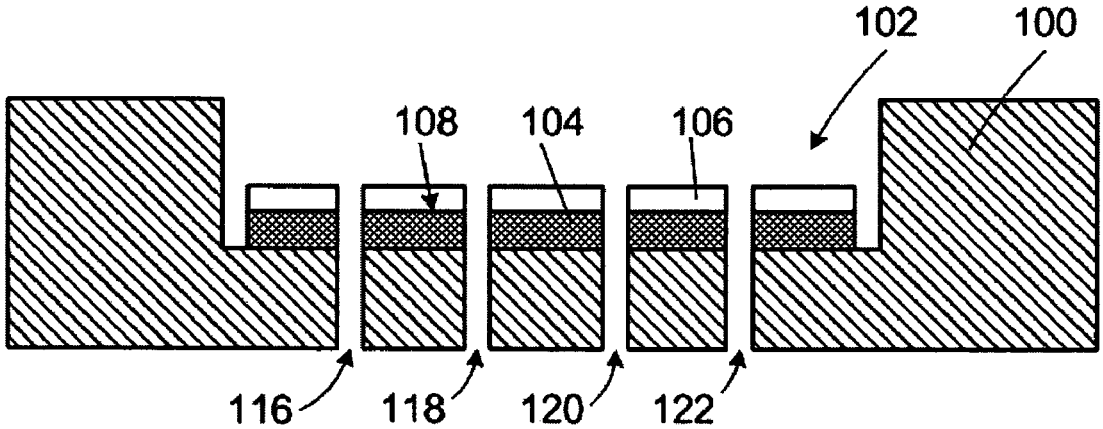

Independent fluid supply paths 42, 44, and 46 (FIGS. 4-5) are provided from each of the fluid chambers 32, 34, and 40 to provide fluid to an ejection head structure 48 attached adjacent the ejection head area 28 of the body structure 14 (FIGS. 1 and 6). The fluids are retained in the chambers 32, 34, and by a cover 50 (FIG. 6) attached to the body structure 14.

The body structure 14 is preferably molded as a unitary piece in a thermoplastic molding process. One preferred material for the body structure 14 is a polymeric material selected from the group consisting of glass-filled polybutylene terephthalate available from G.E. Plastics of Huntersville, N.C. under the trade name VALOX 855, amorphous thermoplastic polyetherimide available from G.E. Plastics under the trade name ULTEM 1010, glass-filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene ether/polystyrene alloy resin available from G.E. Plastics under the trade names NORYL SE1 and NORYL 300X and polyamide/poly-phenylene ether alloy resin available from G.E. Plastics under the trade name NORYL GTX. A preferred material for making the body structure 14 is VALOX 855 resin.

The ejection head structure 48 contains fluid ejection actuators 52 (FIG. 7) such as heater resistors or piezoelectric devices to eject fluid from the ejection head structure 48. Fluid to the actuators 52 is provided from the body structure 14 through corresponding fluid feed paths 54, 56, and 58 (FIGS. 6-7) in the ejection head structure 48 and fluid flow paths 60, 62, and 64 in the body structure 14. A flexible circuit 66 containing electrical contacts 68 thereon is provided and attached to the ejection head structure 48 and body structure 14 to provide electrical energy to the actuators 52 when the cartridge body 10 is attached to an ejection device such as the ink jet printer 12.

Providing two or more fluid chambers, such as the chambers 32, 34, and 40, in a single body structure 14 increases the technical difficulties of using an injection molding process for making the body structure 14. If the body structure 14 is molded from a polymeric material as a single molded unit, there can be significant challenges to molding suitable fluid flow paths 60-64 in the body structure 14 using conventional mold construction and molding techniques. Such challenges include, but are not limited to, the complexity of cooling and filling the mold used for the injection molding process.

By way of further background, reference is made to FIG. 8 which illustrates a prior art method for forming the fluid flow paths 60-64 in ejection head area 28 of the body structure 14. In the prior art process removable core pins 68A-68B, 70A-70B, and 72A-72B are used during a molding process for the body structure 14 to create fluid flow paths 60-64 in the body structure 14. Each of the core pins is provided by A and B sections that are inserted and removed from opposite sides of the body structure 14. The core pins 68A-68B, 70A-70B, and 72A-72B necessarily have a size sufficient to survive the molding process. Likewise, spacings 74 and 76 between the core pins 68A-68B, 70A-70B, and 72A-72B must be wide enough to allow plastic to flow.

The limitations of the core pin size and the spacings 74-76 directly impact the ability to reduce the spacing between adjacent flow paths 60-64. Because the flow paths 60-64 must align with the corresponding fluid feed paths 54-58 in the ejection head structure 48, the foregoing limitations also directly impact the minimum size of an ejection head structure 48 made by conventional techniques.

A body structure 14 made using core pins 68A-68B, 70A-70B, and 72A-72B is illustrated in FIG. 9. Each of the flow paths 60-64 made by core pins 68A-68B, 70A-70B, and 72A-72B has a minimum width $W_1$ of about 0.6 millimeters providing an overall width $W_2$ ranging from about 2.5 to about 3.6 millimeters to provide three fluid flow paths 60-64 in the body structure 14. As the number of flow paths increases, the width $W_2$ also increases using the prior art molding process. In general, a practical limit of number of flow paths per width $W_1$ is typically about one or less flow paths per millimeter width $W_1$.

In order for the fluid flow paths 60-64 to be moved closer together, the core pins 68A-68B, 70A-70B, and 72A-72B would necessarily have to be substantially smaller. However, smaller core pins 68A-68B, 70A-70B, and 72A-72B are less able to survive a molding process as they would be too weak to be suitably removed from the molded body structure 14.

A multi-fluid body structure also presents challenges for sealing an ejection head to the ejection head area without blocking narrow fluid feed paths in the ejection head substrate when a molded body structure as described above is used. For example, with reference to FIG. 10, a body structure 78 contains four fluid flow paths 80, 82, 84, and 86. For simplification purposes, only a semiconductor substrate 88 containing fluid feed paths 90, 92, 94, and 96 is illustrated attached to the body structure 78. In this case, the fluid feed paths 90-96 have a width $W_3$ that is less than a width $W_4$ for the body structure 78. Accordingly, when an adhesive 98 is applied to attach the substrate 88 to the body structure 78, one or more of the fluid feed paths 90-96 may be blocked by the adhesive 98. Also, it is difficult to apply the adhesive 98 with a bond line width of less than about 600 microns using conventional adhesive application techniques such as needle deposition of adhesives.

In order to overcome the molding and adhesive problems described above, so as to provide a micro-fluid ejection device structure containing a relatively high density of fluid slots therein, reference is made to FIGS. 11-20. For purposes of this disclosure, the number of fluid slots or paths within a given linear dimension W is defined as the fluid path density. The term "high density" means that for a given width dimension W of the ejection head structure 48, there is more than one fluid flow feed per millimeter. Also, for the purposes of this disclosure, bond line density is defined as a number of adhesive bond lines between parallel flow paths divided by a linear width dimension for the flow paths as described in more detail below.

With reference to FIG. 11, a portion of a body structure 100 containing an ejection head area or chip pocket 102 is illustrated. Unlike the prior art body structures 14 and 78, the body structure 100 is molded without forming fluid flow paths in the structure 100. In this embodiment, the body structure 100 may be molded from a NORYL resin, selected from the resins described above. The body structure 100 may an integral portion of the fluid cartridge 10 or may be a structure separately attached to the fluid cartridge 10.

In a first step of a process to provide an improved micro-fluid ejection device structure, a pre-formed adhesive material 104 is applied to the body structure 100 in the chip pocket 102 as shown in FIG. 12. The pre-formed adhesive material 104 has solid-like properties such that the adhesive 104 does not flow sufficient to block fluid paths in the body structure 100 or substrate attached to the body structure 100 before or during curing of the adhesive 104. The pre-formed adhesive material 104 may be a tacky B-staged adhesive, such as the adhesive described in U.S. Pat. No. 6,686,425 to Wigdorski et al., the disclosure of which is incorporated herein by reference. The B-staged adhesive may be cured by heat, microwave energy, or ultraviolet light. A polyethylene terephthalate release liner 106 is applied to one surface 108 of the adhesive 104.

Next, laser ablation of the adhesive/liner 104/106 and body structure 100 is conducted with ultra-violet or infrared laser beams 110 from an excimer laser source 112. The laser beams 110 are directed through a mask 114 to provide precise ablation of the adhesive/liner 104/106 and body structure 100 for fluid flow paths indicated by the dashed lines 114. During ablation of the fluid flow paths, the release liner 106 remains in place over on the surface 108 of the adhesive 104 to protect the surface 108 from contamination by undesirable ablation debris. A body structure 100 and adhesive/liner 104/106 containing fluid flow paths 116, 118, 120, and 122 ablated therein in illustrated in FIG. 14.

Unlike the body structures 14 and 78 of FIGS. 8-10 containing molded fluid flow paths 60-64 and 80-86, the overall width $W_5$ of the fluid flow paths 116-122 may be significantly decreased providing a fluid path density of greater than 1 fluid path per millimeter. For example, from about 1.2 to about 3 fluid paths per millimeter may be provided by the foregoing process.

The foregoing embodiment may also be effective to provide decreased bond line widths $W_6$. For example, a bond line width $W_6$ of less than 600 microns, preferably from about 100 to about 400 microns, may be provided between adjacent fluid feed paths 120 and 122 as shown in FIG. 15.

Figure 15:
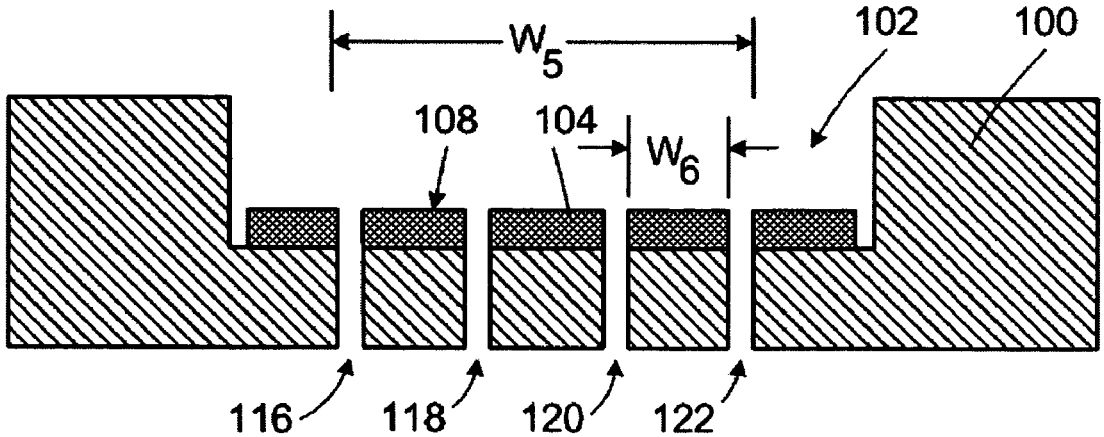
Figure 16:
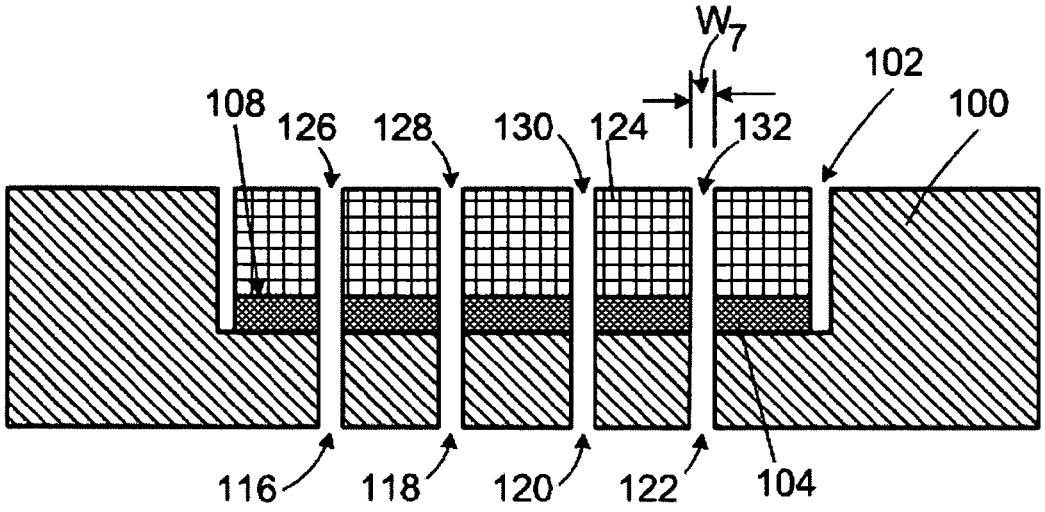
Figure 17:
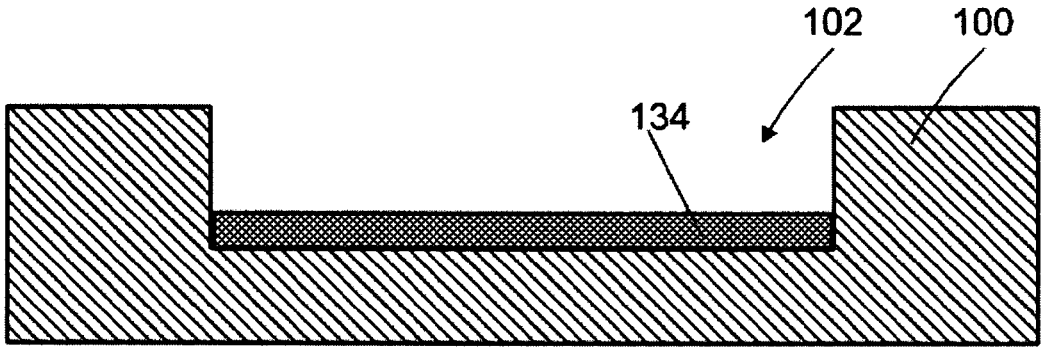
FIGS. 17-20 are cross-sectional views, not to scale, of a process for forming fluid paths in an adhesive layer and cartridge body structure according to a second embodiment of the disclosure.
Figure 18:
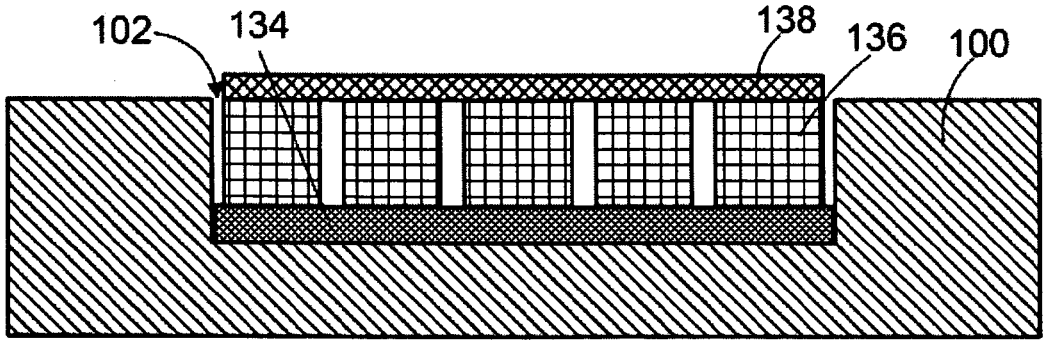
Figure 19:
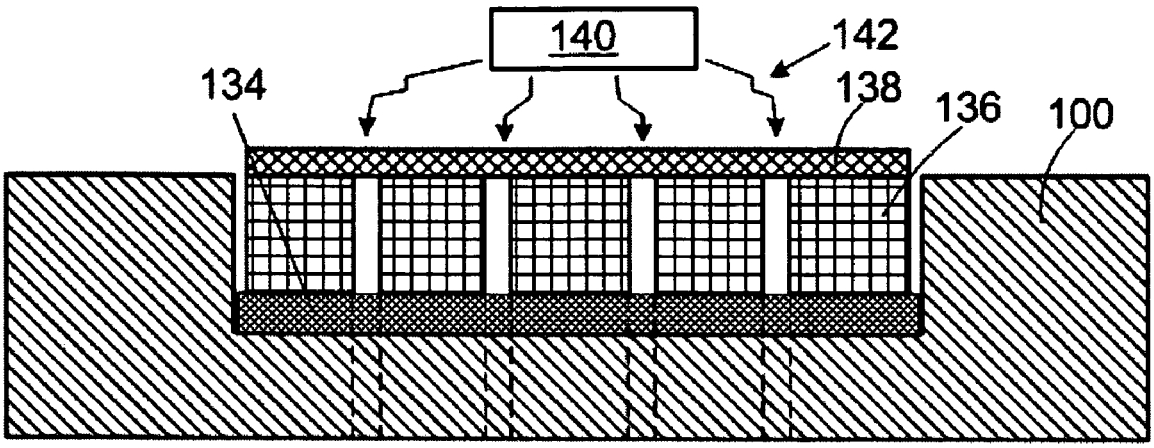

Once the ablation step is complete, the release liner 106 may be removed from the surface 108 of the adhesive 104 as shown in FIG. 15. In FIG. 16, a semiconductor substrate 124 is then attached the surface 108 of the B-stage adhesive and the adhesive 104 is cured. The substrate 124 contains fluid feed paths 126, 128, 130, and 132 therein corresponding to the fluid flow paths 116-122 in the body structure 100. The fluid feed paths 126-132, like the fluid flow paths 116-122 may have widths $W_7$ ranging from about 50 to about 2000 microns. After attaching the substrate 124 to the adhesive 104, the adhesive 104 is thermally cured to affix the substrate 124 to the adhesive 104. Although not shown in FIG. 16, the substrate 124 may include a nozzle plate attached thereto to provide the ejection head structure 48.

An alternative embodiment of the disclosure is illustrated in FIGS. 17-20. In this embodiment, adhesive 134 may be a preformed thermally curable adhesive structures as described above, with or without the release liner, or the adhesive 134 may be deposited from a liquid dispenser or spin coated onto the body structure 100 in the chip pocket 102. As with the previous embodiment, the body structure 100 contains no preformed fluid flow paths therein.

Figure 20:
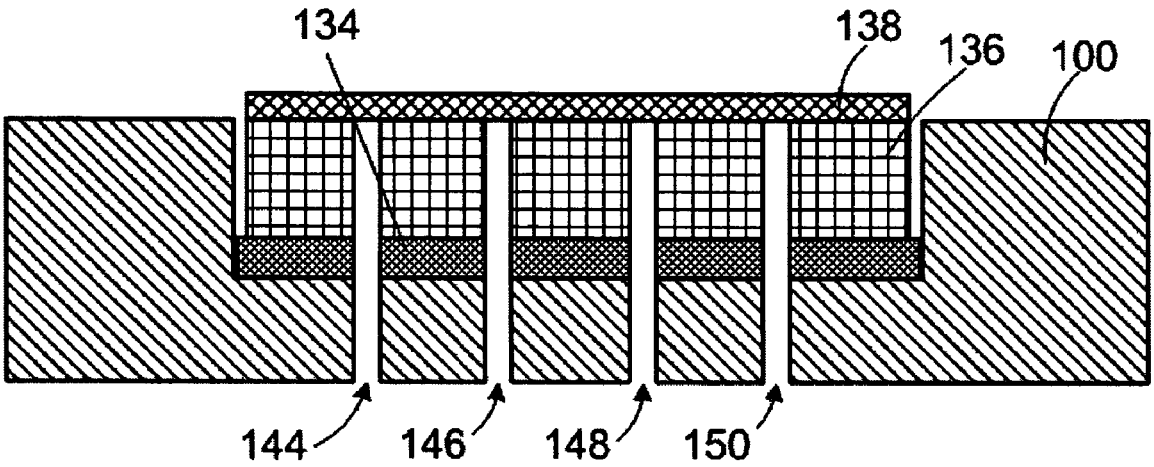

Next, a semiconductor substrate 136 containing a nozzle plate 138 is applied to the adhesive 134 and the adhesive 134 is cured, as by a conventional die bond baking process. The nozzle plate 138 may be a polyimide nozzle plate. However, with a polyimide nozzle plate 138, an excimer laser having laser beams in the ultra-violet range cannot be used without damaging the nozzle plate 138. However, the polyetherimide nozzle plate 138 is transparent to infrared laser beams. Accordingly, a pulsed infrared laser 140, such as a ND:YAG laser providing infrared laser beams 142, may be used to ablate the adhesive 134 and body structure 100 to form fluid flow paths 144, 146, 148, and 150 as shown in FIG. 20. When the infrared laser beams 142 pass through the nozzle plate and focus on the adhesive 134 and the body structure 100, the absorbed energy breaks down the die bond adhesive 134 as well as NORYL material of the body structure 100 providing the flow paths 144-150.

Such laser machining processes as described above provide relatively clean and precisely located fluid flow paths 116-122 and 144-150 having widths $W_7$ as small as several microns wide. The foregoing laser ablation processes forego the need to mold or otherwise machine cut flow paths in the body structure 100. The processes thus provide more precise control of adhesive bond lines thereby providing a higher density of adhesive bond lines for such structures as compared to needle deposition, stencil, screen printing of adhesives in the chip pockets of the body structures, without the need to align fluid feed paths in the substrate 136 with fluid flow paths 144, 146, 148, and 150 in the body structure 100.

Another advantage of the foregoing embodiments can be that excessive compression of the adhesive 104 or 134 in the bonding area between the substrate 124 or 136 and the body structure 100 is minimized. Excessive adhesive compression may lead to adhesive bulging into the flow paths 116-122 or 144-150 which may block the flow paths. However, the preformed adhesive 104 or adhesive 134 applied to the chip pocket 102 may have a controlled height which leads to tighter control over a bond line height and bond line width $W_6$ (FIG. 15) thereby enabling a greater density of adhesive bond lines to used to attach the substrates 124 and 136 to the body structure 100. A greater density of adhesive bond lines can provide either more bond lines for a given bonding areas or can provide the ability to bond a smaller substrate 124 or 136 to the body structure 100.

For a micro-fluid ejection head structure 48 having three parallel flow paths 60-64 (FIG. 7), four bond lines seal the ejection head structure 48 to the body structure 14. An ejection head structure 48 containing n number of parallel flow paths will typically use n+1 bond lines to seal the flow paths to the body structure. An exception to this rule is when a fluid chamber in a body provides the same fluid to two or more of the flow paths in the ejection head structure. Accordingly, the foregoing method enables a substantial increase in bond line density. Conventional technology enables a bond line density of about 0.7 $mm^{-1}$. The foregoing methods enable bond line densities of greater than about 0.7 $mm^{-1}$, preferably from about 0.8 to about 2 $mm^{-1}$.

As will be appreciated, the foregoing embodiments enable production of micro-fluid ejection device structures having a supply path density ranging from greater than 1.00 $mm^{-1}$ up to about 3.0 $mm^{-1}$. The increased supply path density enables the use of smaller substrates thereby reducing the cost of the micro-fluid ejection device structures.

It is contemplated, and will be apparent to those skilled in the art from the preceding description and the accompanying drawings, that modifications and changes may be made in the embodiments of the disclosure. Accordingly, it is expressly intended that the foregoing description and the accompanying drawings are illustrative of exemplary embodiments only, not limiting thereto, and that the true spirit and scope of the present embodiments be determined by reference to the appended claims.

What is claimed is:

1. A micro-fluid ejection device structure, comprising:

a fluid supply body containing at least three fluid supply slots therein;

an ejection head substrate having fluid feed slots therein attached to the fluid supply body, each of the fluid supply slots in the body being in flow communication with at least one of the fluid feed slots in the substrate, wherein the substrate has a fluid feed slot density ranging from about 1.2 to about 3.0 fluid feed slots per millimeter; and a plurality of adhesive bond lines adhesively attaching the ejection head substrate and the fluid supply body to one another, each of the adhesive bond lines having a width of less than about 600 microns and being located between adjacent ones of the fluid supply slots in the body.

2. The micro-fluid ejection device structure of claim 1, wherein the adhesive comprises a laser ablated preformed adhesive layer.

3. The micro-fluid ejection device structure of claim 2, wherein the adhesive is a B-staged ultraviolet (UV), microwave, or thermally curable adhesive.

4. The micro-fluid ejection device structure of claim 1, wherein the bond line width between adjacent fluid supply slots ranges from about 100 to about 400 microns.

5. The micro-fluid ejection device structure of claim 1, wherein the adhesive comprises an infra red absorptive die bond adhesive.

6. The micro-fluid ejection device structure of claim 1, wherein the fluid feed slots and the fluid supply slots have a width ranging from about 50 microns to about 2000 microns.

* * * * *